US011125044B2

(12) United States Patent
Ramirez et al.

(10) Patent No.: US 11,125,044 B2
(45) Date of Patent: Sep. 21, 2021

(54) PRESSURIZED FLOTATION FOR TUBULAR INSTALLATION IN WELLBORES

(71) Applicant: Saudi Arabian Oil Company, Dhahran (SA)

(72) Inventors: Andres A. Ramirez, Khobar (SA); Alaa Wahbi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/294,142

(22) Filed: Mar. 6, 2019

(65) Prior Publication Data

US 2020/0284119 A1 Sep. 10, 2020

(51) Int. Cl.

| | |
|---|---|
| ***E21B 7/04*** | (2006.01) |
| ***E21B 33/10*** | (2006.01) |
| ***E21B 34/06*** | (2006.01) |
| ***E21B 34/08*** | (2006.01) |

(52) U.S. Cl.

CPC ..... *E21B 33/10* (2013.01); *E21B 7/046* (2013.01); *E21B 34/063* (2013.01); *E21B 34/08* (2013.01); *E21B 2200/01* (2020.05)

(58) Field of Classification Search

CPC combination set(s) only.
See application file for complete search history.

(56) References Cited

U.S. PATENT DOCUMENTS

| | | | | |
|---|---|---|---|---|
| 3,398,794 | A * | 8/1968 | Fox, Jr. | E21B 43/10 166/67 |
| 3,448,750 | A * | 6/1969 | Parks | B01J 3/002 137/14 |
| 3,526,280 | A | 9/1970 | Aulick | |
| 3,572,432 | A | 3/1971 | Aulick | |
| 4,986,361 | A | 1/1991 | Mueller et al. | |
| 5,117,915 | A | 6/1992 | Mueller et al. | |

(Continued)

FOREIGN PATENT DOCUMENTS

| | | |
|---|---|---|
| WO | 9103620 | 3/1991 |
| WO | 9217679 | 10/1992 |
| WO | 2006101606 | 9/2006 |

OTHER PUBLICATIONS

PCT International Search Report and Written Opinion in International Appln. No. PCT/US2020/020891, dated Jun. 2, 2020, 14 pages.

*Primary Examiner* — Giovanna Wright
*Assistant Examiner* — Ronald R Runyan
(74) *Attorney, Agent, or Firm* — Fish & Richardson P.C.

(57) ABSTRACT

An apparatus includes a tubular, a base, and a float shoe. The base includes a first sealing member and a flow control device. The first sealing member is configured to prevent fluid flow into and out of the inner volume of the tubular up to a first pressure differential value. The first sealing member is configured to rupture when exposed to a pressure differential that is at least equal to the first pressure differential value. The flow control device is configured to allow fluid to enter the inner volume and prevent fluid from exiting the inner volume through the flow control device. The float shoe includes a second sealing member configured to prevent fluid flow into and out of the inner volume up to a second pressure differential value and configured to rupture when exposed to a pressure differential that is at least equal to the second pressure differential value.

14 Claims, 6 Drawing Sheets

(56) References Cited

U.S. PATENT DOCUMENTS

| | | | | |
|---|---|---|---|---|
| 5,181,571 | A | 1/1993 | Mueller et al. | |
| 7,549,479 | B2 | 6/2009 | Biegler et al. | |
| 7,789,162 | B2 * | 9/2010 | Keller | E21B 34/06 166/386 |
| 2002/0117309 | A1 * | 8/2002 | Guillory | E21B 23/02 166/387 |
| 2003/0116324 | A1 | 6/2003 | Dawson et al. | |
| 2007/0295513 | A1 | 12/2007 | Biegler et al. | |
| 2009/0255691 | A1 * | 10/2009 | Loughlin | E21B 33/127 166/387 |
| 2011/0284242 | A1 * | 11/2011 | Frazier | E21B 34/063 166/376 |
| 2014/0216756 | A1 * | 8/2014 | Getzlaf | E21B 7/20 166/376 |
| 2015/0308227 | A1 | 10/2015 | Morrison | |

* cited by examiner

PRESSURIZED FLOTATION FOR TUBULAR INSTALLATION IN WELLBORES

TECHNICAL FIELD

This disclosure relates to flotation applications in installing tubulars in wellbores.

BACKGROUND

Directional drilling allows for wells to be drilled at multiple angles (not just vertically) to better reach and produce hydrocarbons from source rocks and reservoirs. Horizontal drilling is a type of directional drilling in which a horizontal well is drilled across a hydrocarbon-containing formation. Extended reach drilling is a type of horizontal drilling and can be classified as having a horizontal reach exceeding the true vertical depth by a factor greater than or equal to two. Directional drilling (especially extended reach drilling) can prove to be particularly challenging and typically requires specialized planning to execute well construction.

SUMMARY

This disclosure describes technologies relating to using flotation to install tubulars in wellbores. Implementing the subject matter described can prevent tubular collapse of a floated section in directional drilling (especially in extended reach drilling) due to the equivalent circulating density (ECD) created as a result of the running speed of the tubular in a well. Certain aspects of the subject matter described can be implemented as an apparatus. The apparatus includes a tubular, a base, and a float shoe. The tubular is configured to be installed in a wellbore. The tubular defines an inner volume. The base is connected to a first end of the tubular. The base includes a first sealing member and a flow control device. The first sealing member is configured to prevent fluid flow into and out of the inner volume up to a first threshold pressure differential value. The first sealing member is configured to rupture when exposed to a pressure differential that is at least equal to the first threshold pressure differential value. The flow control device is configured to allow fluid to enter the inner volume and prevent fluid from exiting the inner volume through the flow control device. By doing so, the flow control device can allow pressurization of the inner volume of the tubular and prevent collapse of the tubular while the tubular is being run in the well. The float shoe is connected to a second end of the tubular. The float shoe includes a second sealing member configured to prevent fluid flow into and out of the inner volume up to a second pressure differential threshold value. The second sealing member is configured to rupture when exposed to a pressure differential that is at least equal to the second threshold pressure differential value.

This, and other aspects, can include one or more of the following features.

The apparatus can include a float collar between the base and the float shoe.

The first threshold pressure differential value and the second threshold pressure differential value can be equal.

The base can include a first seat upon which the first sealing member can be seated to prevent movement of the first sealing member relative to the base. The float shoe can include a second seat upon which the second sealing member can be seated to prevent movement of the second sealing member relative to the float shoe.

When the apparatus is positioned within the wellbore, a downhole portion of the first sealing member can be seated on the first seat. A downhole portion of the second sealing member can be seated on the second seat.

The apparatus can include a flotation fluid within the inner volume. The flotation fluid can have a density that is less than a surrounding fluid within which the apparatus is configured to be submerged to provide buoyancy.

The flotation fluid can include an inert gas.

Each of the first sealing member and the second sealing member can include a rubber membrane.

Certain aspects of the subject matter described can be implemented as a method. An apparatus is positioned within a wellbore. The apparatus includes a tubular, a base, and a float shoe. The tubular defines an inner volume. The base is connected to a first end of the tubular. The base includes a first sealing member and a flow control device. The first sealing member is configured to prevent fluid flow into and out of the inner volume up to a first threshold pressure differential value. The flow control device is configured to allow fluid to enter the inner volume and prevent fluid from exiting the inner volume through the flow control device. The base defines a pathway connecting the flow control device to the inner volume. The float shoe is connected to a second end of the tubular. The float shoe includes a second sealing member configured to prevent fluid flow into and out of the inner volume up to a second threshold pressure differential value. After positioning the apparatus, the first sealing member is ruptured by exposing the first sealing member to a pressure differential that is at least equal to the first threshold pressure differential value. The second sealing member is ruptured by exposing the second sealing member to a pressure differential that is at least equal to the second threshold pressure differential value. The tubular is secured within the wellbore.

This, and other aspects, can include one or more of the following features.

The first threshold pressure differential value and the second threshold pressure differential value can be equal.

A flotation fluid can be injected through the flow control device into the inner volume before positioning the apparatus within the wellbore.

The flotation fluid can include an inert gas.

The amount of flotation fluid to inject into the inner volume of the apparatus sufficient to prevent collapse of the tubular as the apparatus is positioned within the wellbore can be determined.

The wellbore can include a horizontal section, and positioning the apparatus within the wellbore can include positioning the apparatus within the horizontal section.

The flotation fluid within the inner volume can be displaced with a surrounding fluid within which the apparatus is submerged. The surrounding fluid can be circulated through the apparatus until a rheology of the surrounding fluid for cementing is reached.

Certain aspects of the subject matter described can be implemented as an apparatus. The apparatus includes a tubular, a first flow control member, and a second flow control member. The tubular is configured to be lowered into a wellbore. The tubular includes a first end and a second end. The first flow control member is configured to seal the first end up to a first threshold pressure differential value and to selectively permit well fluid into the tubular. The second flow control member is configured to seal the second end up to a second threshold pressure differential value. The first flow control member, the second flow control member, and the tubular define an inner volume filled with an inert gas.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes flotation as it relates to installing tubulars in wellbores. In some wells (for example, horizontal or extended reach wells), it is difficult to run a tubular because of friction generated as the tubular is positioned within a wellbore. The subject matter described here can be implemented to realize one or more of the following advantages. Floating the tubular by running a lower section filled with a flotation fluid can create a buoyancy effect and mud on top can exert an axial down force to assist in running the tubular downhole. The lower section (containing the flotation fluid) can be pressurized to prevent the tubular from collapsing due to various factors, for example, running speed, mud rheology, mud weight, tubular design parameters (such as thickness and pressure rating), and wellbore diameter (also in relation to the tubular diameter). In cases where it is not viable or economical to alter such factors, the apparatuses and methods described herein can be implemented to prevent collapse as the tubular is run in the well. Pressurizing the floated section of the tubular can prevent collapse of the tubular in directional drilling (especially in extended reach drilling) due to the equivalent circulating density (ECD) created as a result of the running speed of the tubular in a well.

Figure 1A:
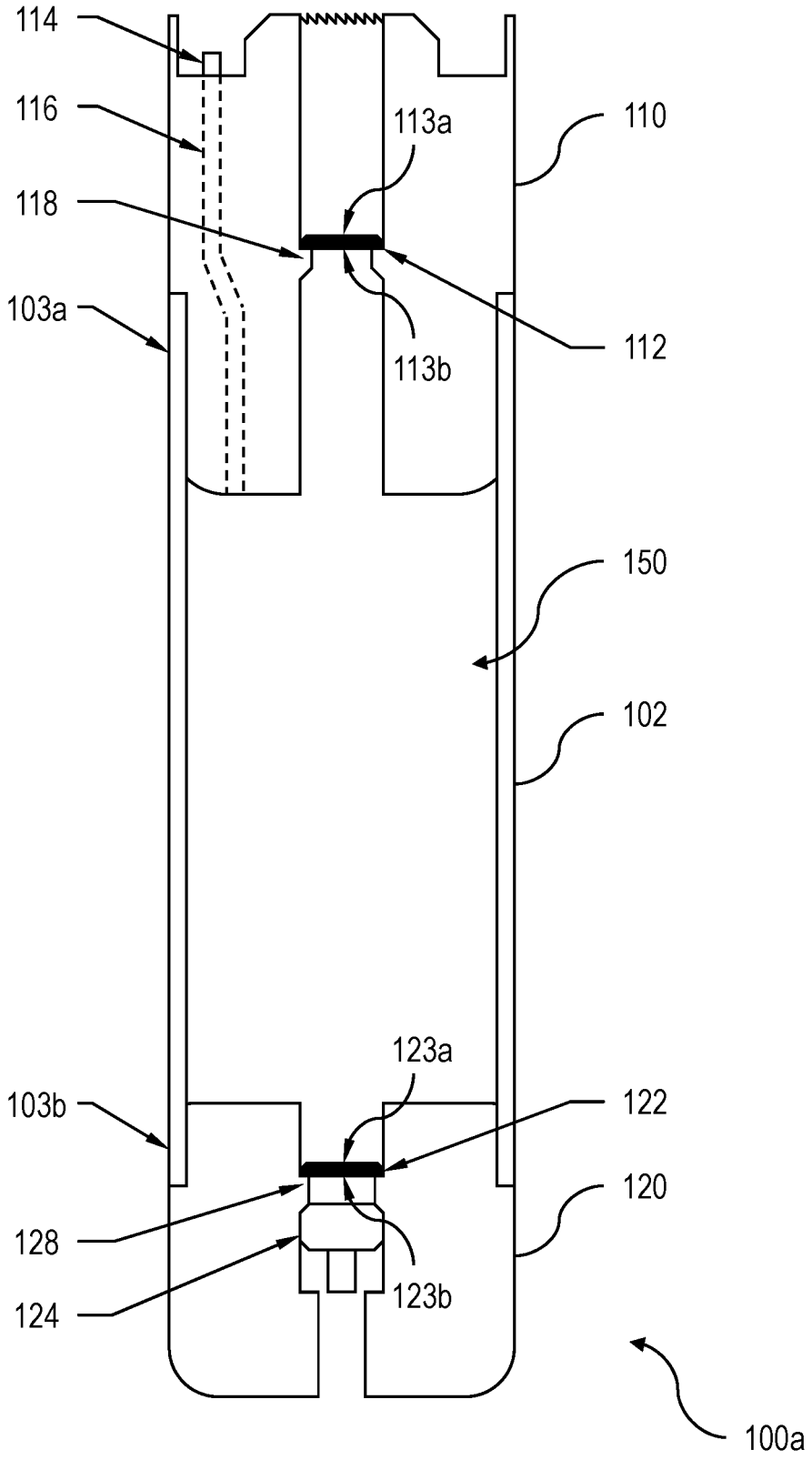
FIGS. 1A & 1B are schematic diagrams of example apparatuses that can be used to install a tubular in a wellbore.

FIG. 1A shows an example apparatus 100*a* for installing tubulars in wellbores. The apparatus 100*a* includes a tubular 102, a base 110 connected to a first end 103*a* of the tubular 102, and a float shoe 120 connected to a second end 103*b* of the tubular 102. The tubular 102 defines an inner volume 150. The tubular 102 can be a tubular, for example, a pipe string, such as a casing string or a production string. The tubular 102 can be made of one or more pipe joints. The apparatus 100*a* can be positioned within a wellbore and used to install the tubular 102 in the wellbore.

In this disclosure, "downhole" means in a general direction deeper within a wellbore, while "uphole" means in a general direction toward the surface. In cases where the apparatus 100*a* is lowered into a wellbore with the float shoe 120 entering the well first, the float shoe 120 can be described as being the downhole end of the apparatus 100*a*, while the base 110 can be described as being the uphole end of the apparatus 100*a*. In such implementations, the float shoe 120 can protect the tubular 102, for example, from snagging or scuffing as the apparatus 100*a* is positioned within the wellbore.

The base 110 includes a first sealing member 112 configured to prevent fluid flow into and out of the inner volume 150 (through the first sealing member 112) up to a first threshold pressure differential value. For example, up to a first threshold pressure differential value of 1,000 pounds per square inch (psi), the first sealing member 112 can prevent fluid flow into and out of the inner volume 150 through the first sealing member 112. When exposed to a pressure differential that is at least equal to the first threshold pressure differential value (for example, 1,010 psi or greater), the first sealing member 112 ruptures. The first sealing member 112 can be, for example, a rupture membrane. Some non-limiting examples of materials suitable for the first sealing member 112 are rubber, elastomer, or polymeric material. Once the first sealing member 112 ruptures, fluid can flow into and out of the inner volume 150 through the ruptured first sealing member 112.

The base 110 can include a first seat 118 upon which the first sealing member 112 can be seated to prevent movement of the first sealing member 112 relative to the base 110. As shown in FIG. 1A, a downhole portion 113*b* of the first sealing member 112 can be seated on (that is, be in contact with) the first seat 118. In some implementations, an uphole portion 113*a* of the first sealing member 112 can be seated on the first seat 118.

The base 110 includes a flow control device 114 configured to allow fluid to enter the inner volume 150 and prevent fluid from exiting the inner volume 150 through the flow control device 114. The flow control device 114 can be, for example, a check valve, a ball valve, or a poppet valve. The inner volume 150 can be connected to the flow control device 114 by a passage 116 formed in the base 110. The inner volume 150 can be filled with a flotation fluid through the flow control device 114. The flotation fluid can have a density less than a surrounding fluid within which the apparatus 100*a* can be configured to be submerged to provide buoyancy. The flotation fluid can be, for example, an inert gas, such as nitrogen gas. In some implementations, the flotation fluid is substantially free of oxygen. In some implementations, the flotation fluid is air. In some implementations, the flotation fluid includes carbon dioxide. The flotation fluid can be pressurized in the inner volume 150.

The float shoe 120 includes a second sealing member 122 configured to prevent fluid flow into and out of the inner volume 150 (through the second sealing member 122) up to a second threshold pressure differential value. For example, up to a second threshold pressure differential value of 1,010 psi, the second sealing member 122 can prevent fluid flow into and out of the inner volume 150 through the second sealing member 122. When exposed to a pressure differential that is at least equal to the second threshold pressure differential value (for example, 1,020 psi or greater), the second sealing member 122 ruptures. The second sealing member 122 can be substantially the same as the first sealing member 122. For example, the second sealing member 122 can also be a rupture membrane made of rubber. Once the second sealing member 122 ruptures, fluid can flow into and out of the inner volume 150 through the ruptured second sealing member 122. In some implementations, the first threshold pressure differential value (at which the first sealing member 112 can rupture) and the second threshold pressure differential value (at which the second sealing member 122 can rupture) are equal. In some implementations, the first and second threshold pressure differential values are different.

The float shoe 120 can include a second seat 128 upon which the second sealing member 122 can be seated to prevent movement of the second sealing member 122 relative to the float shoe 120. As shown in FIG. 1A, a downhole portion 123*b* of the second sealing member 122 can be seated on the second seat 128. In some implementations, an uphole portion 123*a* of the second sealing member 122 can be seated on the second seat 128.

The float shoe 120 can include a float valve 124 configured to prevent fluid from entering the inner volume 150 through the float valve 124. The float valve 124 can, however, allow fluid to exit the inner volume 150. Even after the second sealing member 122 has ruptured, the float valve 124 prevents fluid from entering the inner volume 150 through the float valve 124.

Figure 1B:
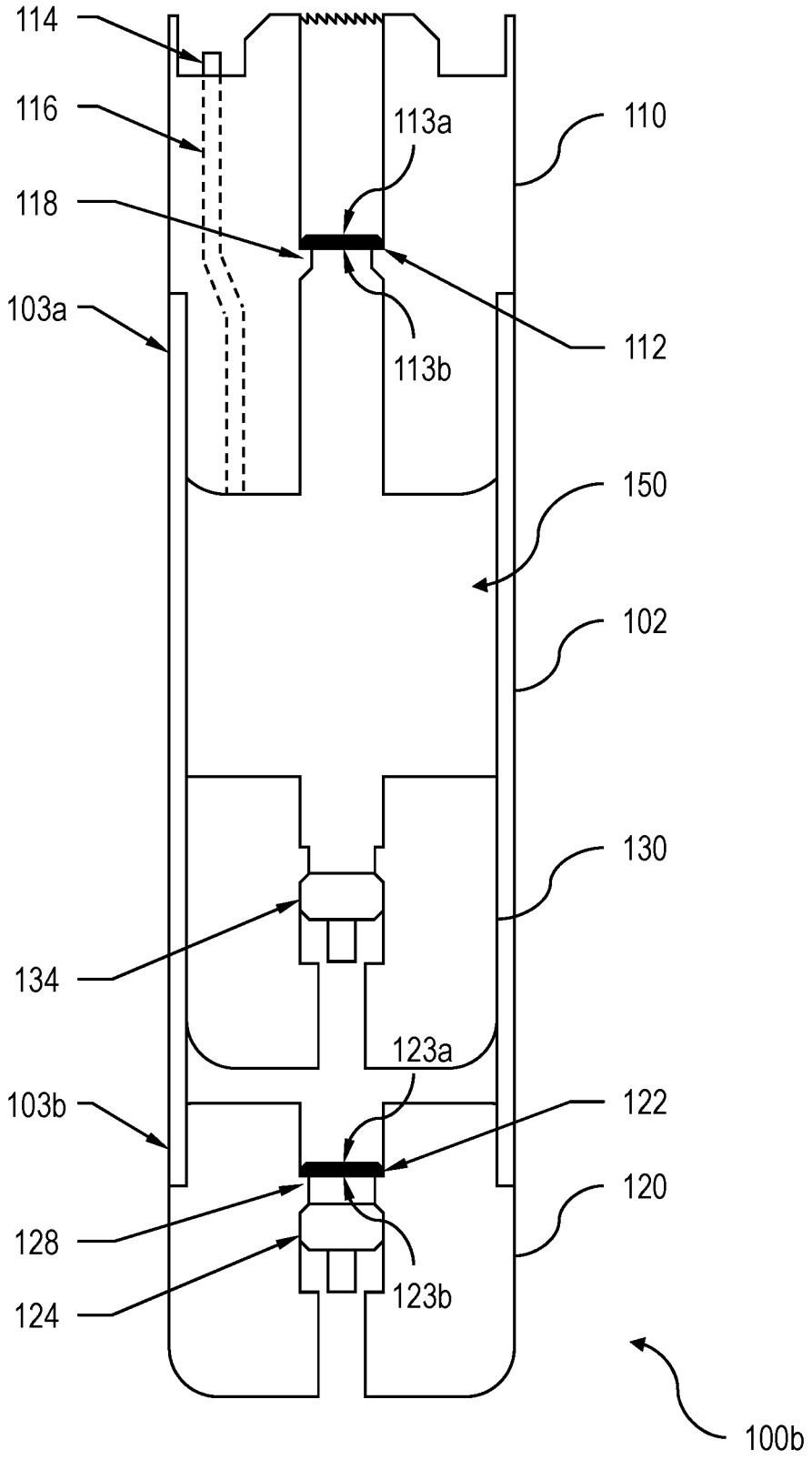

FIG. 1B shows an example apparatus 100*b* for installing tubulars in wellbores. The apparatus 100*b* can be substantially the same as the apparatus 100*a* and further include a float collar 130. The float collar 130 can be substantially the same as the float shoe 120, but free of a sealing member like the second sealing member 122. The float collar 130 can be included for redundancy as an additional layer of protection from fluid entering the inner volume 150.

Figure 2:
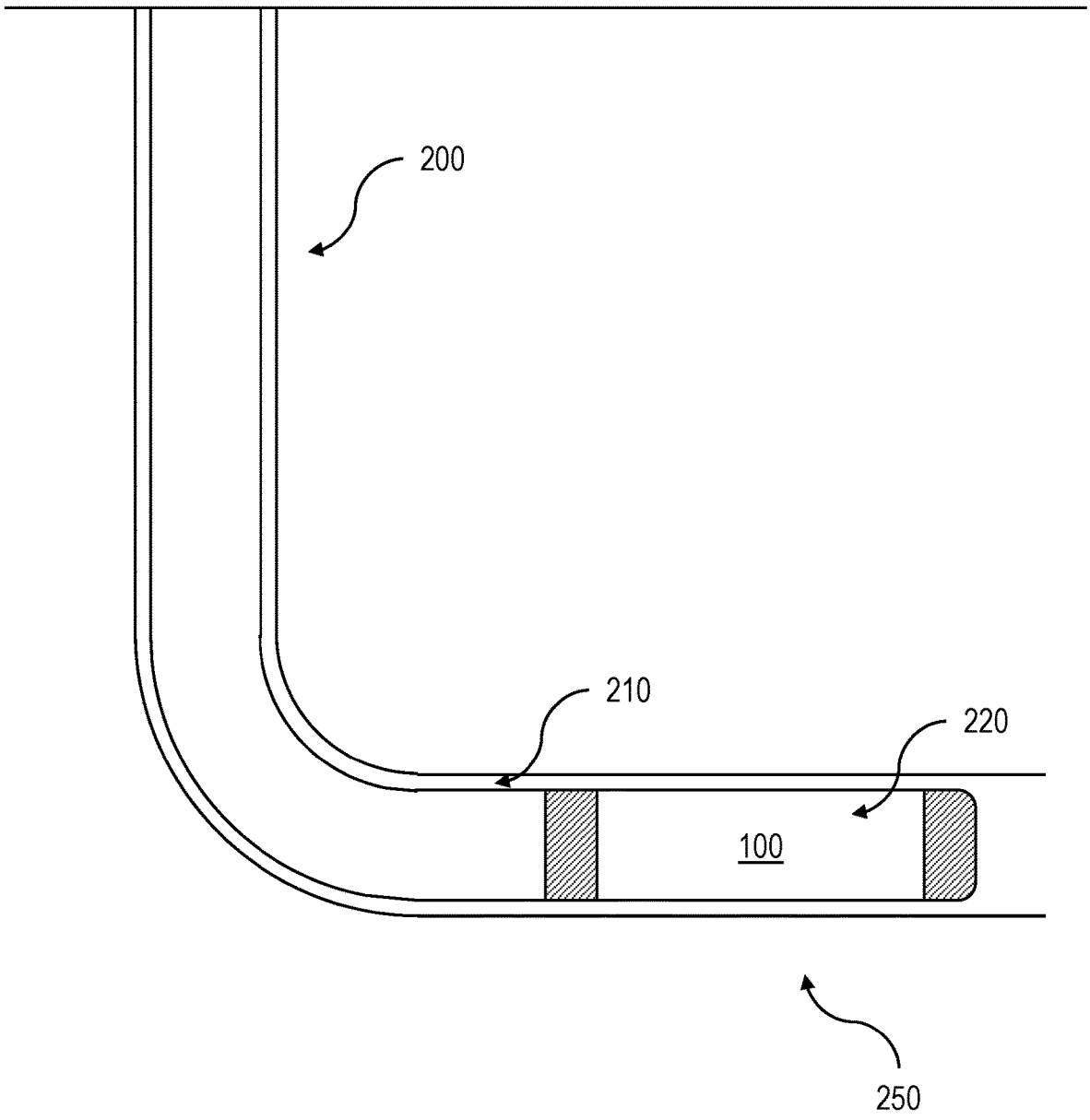
FIG. 2 is a schematic diagram of an example apparatus within a wellbore.

FIG. 2 shows an example apparatus 100 within a wellbore 200. The apparatus 100 can be substantially the same as the apparatus 100*a* or the apparatus 100*b* described previously. As shown in FIG. 2, the apparatus 100 can be positioned within a horizontal portion 250 of the wellbore 200. The apparatus 100 can be surrounded with a surrounding fluid 210 (such as drilling mud) within the wellbore 200. The apparatus 100 can contain a flotation fluid 220 within an inner volume (150) of the apparatus 100. The flotation fluid 220 can have a density less than that of the surrounding fluid 210, thereby providing buoyancy to the apparatus 100 as the apparatus 100 is positioned within the horizontal portion 250 the wellbore 200. The flotation fluid 220 can be pressurized to prevent collapse of the tubular 102 as the apparatus 100 is positioned within the wellbore 200.

Figure 3:
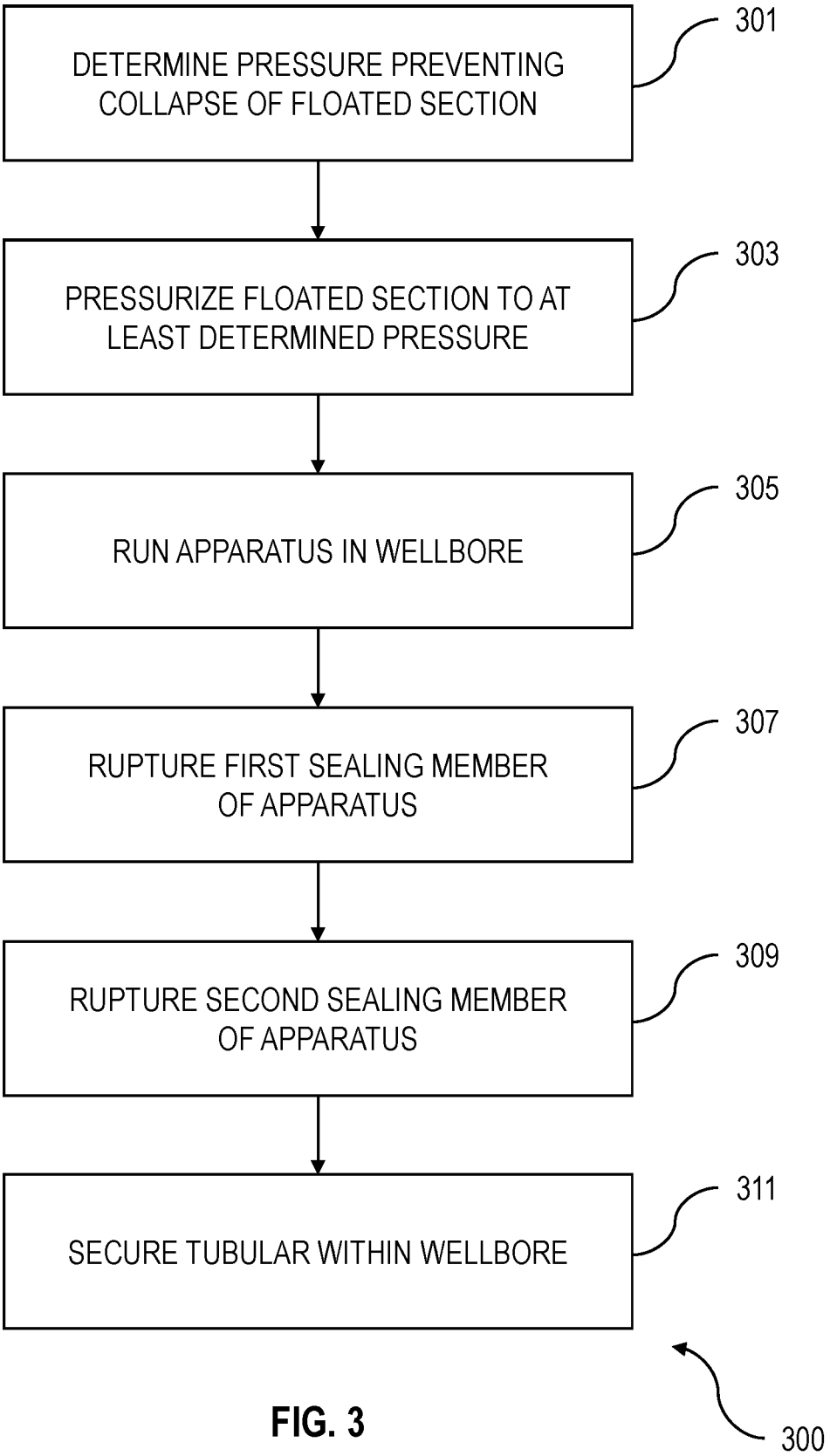
FIG. 3 is a flow chart of an example method for installing a tubular in a wellbore.

FIG. 3 shows a flow chart of a method 300 that can be used to install a tubular in a wellbore. At step 301, a pressure at which collapse of a floated section of an apparatus (such as the tubular 102 of apparatus 100*a* or 100*b*) being run in a wellbore (such as wellbore 200) can be prevented is determined. This pressure can depend on various factors, such as running speed of the floated section, diameter of the floated section, diameter of the wellbore, temperature of the wellbore, final depth of the floated section within the wellbore, and properties of the floated section (such as design pressure). An example calculation of step 301 is provided later.

At step 303, the floated section is pressurized to at least the pressure determined at step 301. A flotation fluid (such as the flotation fluid 220) can be injected into the tubular 102 through the flow control device 114 to pressurize the floated section. Flotation fluid can be injected into the tubular 102 until an internal pressure of the inner volume 150 of the tubular 102 is at least the pressure determined at step 301. By pressurizing the floated section at step 303, collapse of the floated section can be prevented while the apparatus (100*a* or 100*b*) is run in the wellbore 200.

At step 305, the apparatus is run in the wellbore 200. The apparatus includes the same components as the apparatus 100*a*, and in some implementations, the apparatus can also include components of the apparatus 100*b*. In some implementations, the apparatus (100*a* or 100*b*) is positioned within a horizontal portion (250) of the wellbore 200.

After positioning the apparatus at step 305, the first sealing member (112) is ruptured at step 307 by exposing the first sealing member 112 to a pressure differential that is at least equal to the first threshold pressure differential value. For example, mud can be injected into the wellbore until the first sealing member 112 is exposed to a pressure differential that is at least equal to the first threshold pressure differential value. Once the first sealing member 112 has ruptured, the surrounding fluid (210) can begin to displace flotation fluid 220 from the inner volume 150. The surrounding fluid 210 can displace the flotation fluid 220 and fill the inner volume 150.

At step 309, the second sealing member (122) is ruptured by exposing the second sealing member 122 to a pressure differential that is at least equal to the second threshold pressure differential value. For example, mud can continue to be injected into the wellbore until the second sealing member 122 is exposed to a pressure differential that is at least equal to the second threshold pressure differential value. Once the first sealing member 112 and the second sealing member 122 have ruptured, the surrounding fluid 210 can be circulated through the apparatus (for example, 100*a*) until a rheology of the surrounding fluid 210 suitable for cementing is reached.

At step 311, the tubular 102 is secured within the wellbore 200. The tubular 102 can be secured within the wellbore 200, for example, by cementing the tubular 102 to the wellbore 200. In some implementations, the tubular 102 is coupled to another component (such as another pipe string) that has already been installed in the wellbore 200. The method 300 can be repeated for additional tubulars.

Example of Method to Prevent Collapse of a Floated Section

The following calculations are provided as an example implementation of step 301 of method 300 to determine the pressure at which collapse of a floated section (such as the tubular 102) being run in a wellbore can be prevented.

Running a tubular with an outer diameter $D_o$ into a well displaces fluid (for example, drilling fluid) from the well at a flow rate Q that corresponds to the running velocity V of the tubular:

$$Q = V \times \frac{\pi D_o^2}{4} \tag{1}$$

This induced flow of fluid creates an equivalent circulating density (ECD) in the annulus between the wellbore and the tubular. The induced ECD produces a pressure on the tubular, and various measures can be taken to ensure that the tubular does not collapse due to this pressure as the tubular is run into the well.

The following can be applied as a design criterion to prevent collapse:

$$DF_{collapse} = \frac{F_{temp} \times F_{wear} \times F_{axial} \times P_{rating}}{P_e - P_i} \tag{2}$$

where $DF_{collapse}$ is a collapse design factor (unitless), $F_{temp}$ is a temperature derating factor (unitless), $F_{wear}$ is a pipe wear derating factor (unitless), $F_{axial}$ is an axial derating factor (unitless), $P_{rating}$ is a collapse pressure rating (in pounds per square inch gauge, psig), $P_e$ is external pressure (in psig), and $P_i$ is internal pressure (in psig). In this example, $DF_{collapse}$ was 1.125 (translating to a 12.5% margin).

The temperature derating factor $F_{temp}$ depends on the material of construction of the tubular and is a derating factor for pipe yield strength due to thermal effects. The temperature derating factor $F_{temp}$ also depends on the operating temperature of the tubular, which is affected by the depth of the tubular within the well. Therefore, $F_{temp}$ can vary as the tubular travels downhole in the well.

The pipe wear derating factor $F_{wear}$ depends on wear and tear of the tubular run into the well, and for this example, $F_{wear}$ is 1.0 because the tubular was new.

The axial derating factor $F_{axial}$ depends on various factors, such as axial load, tubular dimensions, and yield strength. $F_{axial}$ can be determined by the following equations:

$$F_{axial} = \sqrt{1 - 0.75\left(\frac{F_t}{A_c Y}\right)^2} - 0.5\frac{F_t}{A_c Y} \tag{3}$$

$$A_c = \frac{\pi(D_o^2 - D_i^2)}{4} \tag{4}$$

where $F_t$ is axial load (in pound force, $lb_f$), $A_c$ is cross-sectional area of the tubular (in square inches, $in^2$), Y is yield strength (in pounds per square inch, psi), and $D_i$ is the inner diameter of the tubular (in inches, in). A more detailed explanation of Equations 3 and 4 can be found in API TR 5C3, titled "Calculating Performance Properties of Pipe Used as Casing or Tubing". The axial load $F_t$ depends on the weight of the tubular, length of the tubular, well friction, centralizer type, mud type (for example, water-based or oil-based), and well inclination. For this example, $F_t$ was 45,000 $lb_f$. The yield strength Y depends on metal grade. In some implementations, the metal grade meets the specifications listed in API Spec 5CT (2004). In some implementations, the metal grade meets the specifications listed in ISO 11960. In some implementations, the yield strength Y is between approximately 40,000 psi and approximately 125,000 psi. For this example, Y was 80,000 psi. For this example, $D_o$ was 9.625 in, and $D_i$ was 8.835 in; therefore, $A_c$ was 11.454 $in^2$.

The collapse pressure rating $P_{rating}$ depends on various factors, such as thickness of the tubular, material of construction, and method of preparation, and for this example, $P_{rating}$ was 3,090 psig. The external pressure $P_e$ depends on the induced ECD due to the running speed of the tubular into the well and can vary as the tubular travels downhole in the well. The internal pressure $P_i$ can be set by injecting flotation fluid within the apparatus (for example, apparatus 100*a*), and for this example, $P_i$ was 400 psig.

The collapse design factor $DF_{collapse}$ for this example was 1.125. The following calculation verifies that an internal pressure $P_i$ was sufficient for running the tubular down to a depth of 19,182 feet (ft) at running speeds up to 0.727 feet per second (ft/s).

Solving Equation 2 for external pressure $P_e$:

$$P_e = \frac{F_{temp} \times F_{wear} \times F_{axial} \times P_{rating}}{DF_{collapse}} + P_i \tag{5}$$

As mentioned earlier, external pressure $P_e$ depends on ECD. The relationship between external pressure $P_e$ and ECD can be described by the following:

$$P_e = \frac{ECD \times D}{144} \tag{6}$$

where D is the total vertical depth of the tubular within the well (in ft).

Combining Equations 5 and 6 and solving for theoretical maximum allowable ECD:

$$ECD = \frac{144 \times F_{temp} \times F_{wear} \times F_{axial} \times P_{rating}}{D \times DF_{collapse}} + \frac{144 \times P_i}{D} \tag{7}$$

The ECD calculated by Equation 7 depends on the total vertical depth (D) of the tubular and provides a theoretical maximum allowable ECD for the tubular to prevent collapse at that depth. To verify that the internal pressure $P_i$ is adequate to prevent collapse, the actual ECD (which depends on total vertical depth and running speed) is compared to the theoretical maximum allowable ECD (Equation 7) all the way down to the final total vertical depth at which the tubular will be ultimately positioned. If the actual ECD remains below the theoretical maximum allowable ECD as the tubular travels down to the final total vertical depth, then the internal pressure $P_i$ is adequate. Therefore, the flotation fluid 210 is pressurized to the determined internal pressure $P_i$ to avoid collapse as the tubular is run downhole.

Figure 4A:
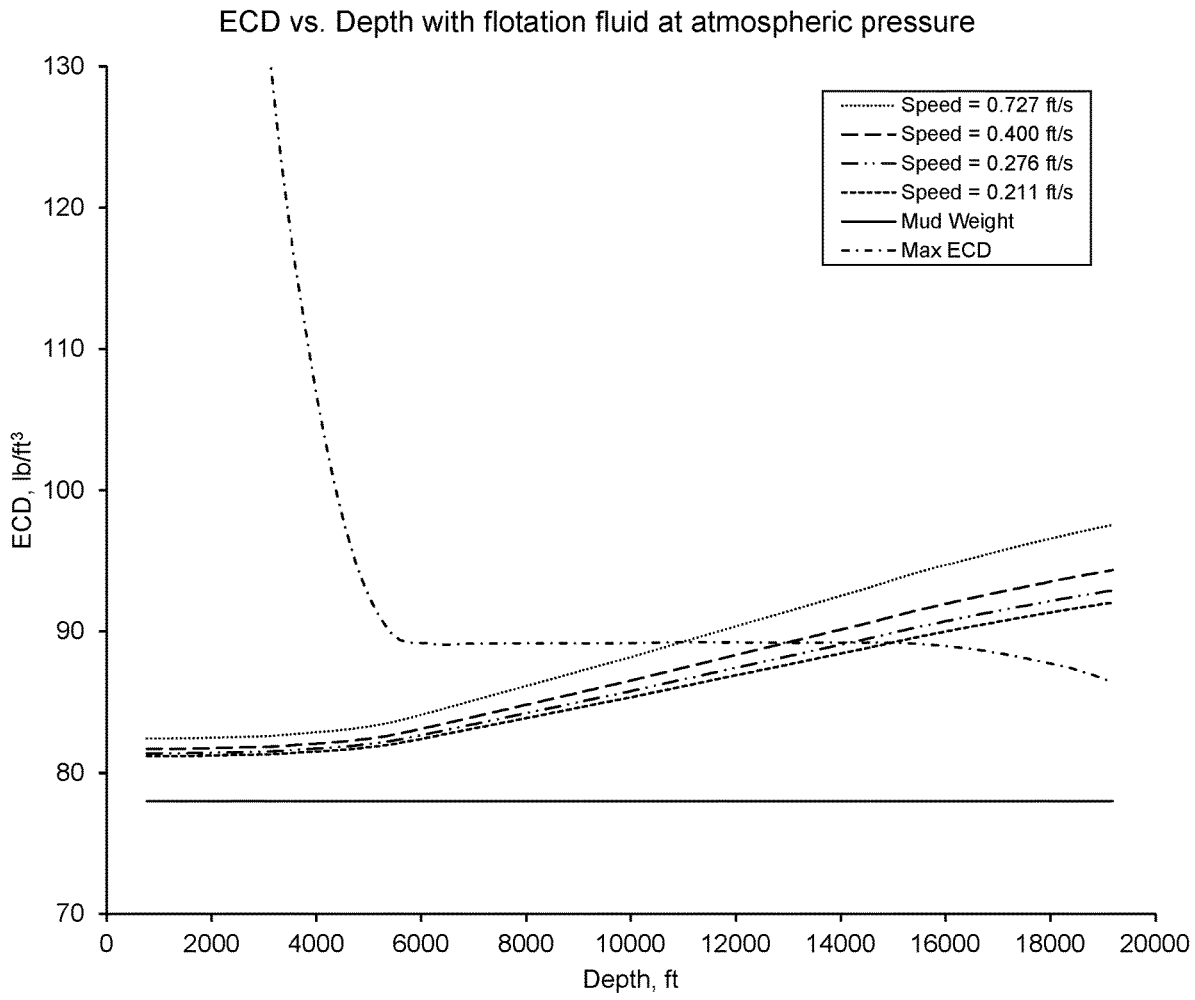
FIGS. 4A & 4B show plots of ECD vs. depth at various running speeds of a tubular being installed in a wellbore using the apparatus.

FIG. 4A shows a plot of ECD vs. depth (D) at various running speeds of the tubular downhole. In this example, the flotation fluid 210 in the apparatus (for example, apparatus 100*a* or 100*b*) is not pressurized and is at atmospheric pressure. As shown in the plot, for a running speed of 0.727 ft/s, the tubular is at risk of collapse at depths deeper than approximately 11,000 ft. For a running speed of 0.400 ft/s, the tubular is at risk of collapse at depths deeper than approximately 13,000 ft. For a running speed of 0.276 ft/s, the tubular is at risk of collapse at depths deeper than approximately 14,000 ft. For a running speed of 0.211 ft/s, the tubular is at risk of collapse at depths deeper than approximately 15,000 ft.

Figure 4B:
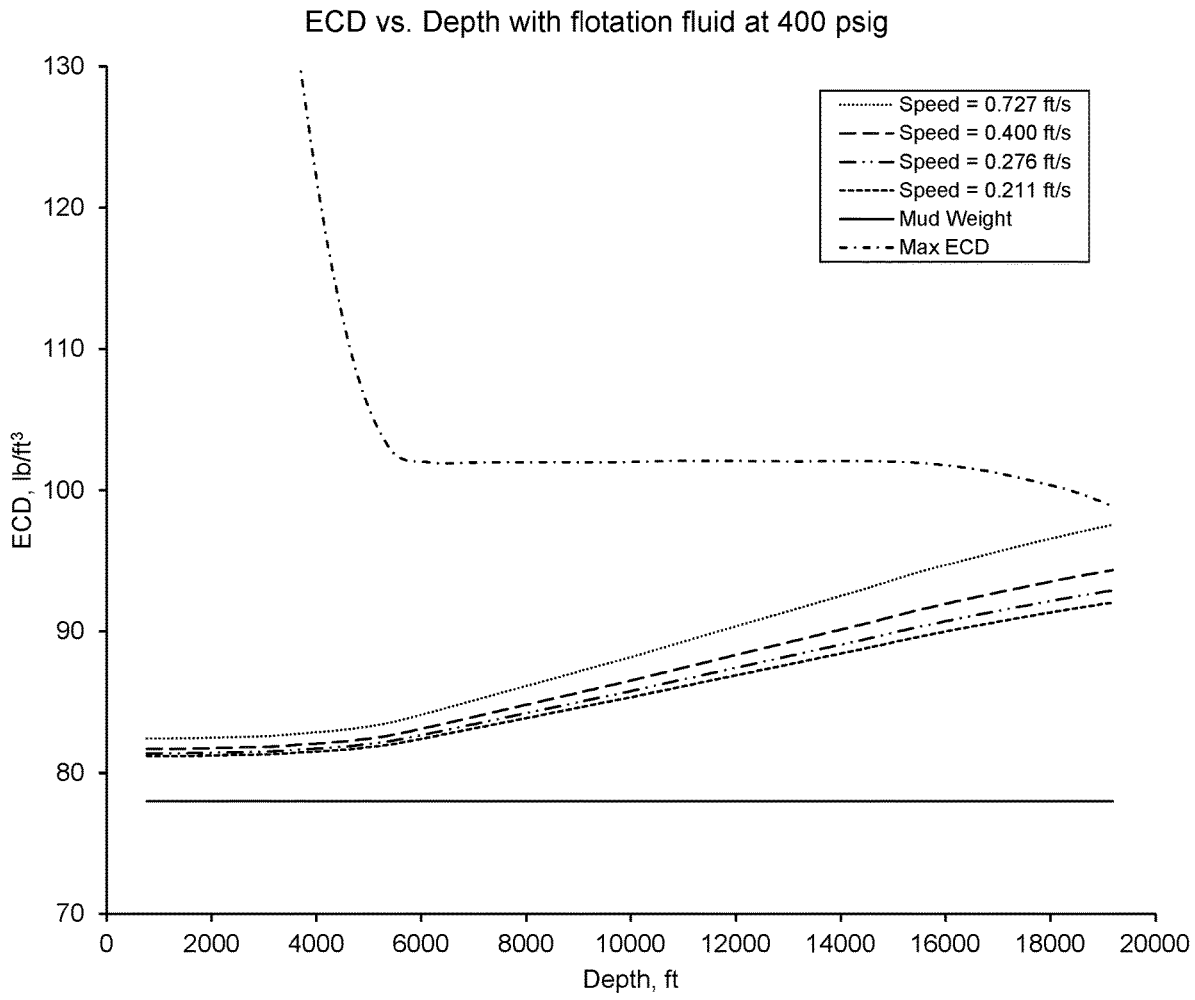

FIG. 4B shows a plot of ECD vs. depth (D) at various running speeds of the tubular downhole. Pressurizing the flotation fluid 210 in the apparatus (100*a* or 100*b*) can increase the maximum allowable ECD, thereby reducing the risk of collapse. In this example, the flotation fluid 210 in the apparatus (100*a* or 100*b*) is pressurized to 400 psig. As shown in the plot, for each of the running speeds (0.727 ft/s, 0.400 ft/s, 0.276 ft/s, and 0.211 ft/s), the tubular is not at risk of collapse at depths up to approximately 19,000 ft. For deeper depths, the flotation fluid 210 in the apparatus (100*a* or 100*b*) can be further pressurized to a greater pressure to further increase the maximum allowable ECD.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. An apparatus comprising:

a tubular configured to be installed in a wellbore, the tubular comprising a first end and a second end, the tubular defining an inner volume between the first end and the second end, wherein when the tubular is installed in the wellbore, the first end is an uphole end, and the second end is a downhole end;

a flotation fluid within the inner volume, the flotation fluid having a density less than a surrounding fluid within which the apparatus is configured to be submerged to provide buoyancy, the flotation fluid providing an internal pressure within the tubular configured to prevent collapse due to an induced equivalent circulating density on the tubular as the tubular is installed in the wellbore;

a base connected to the first end of the tubular, the base comprising:

a first sealing member configured to prevent fluid flow into and out of the inner volume up to a first threshold pressure differential value, the first sealing member configured to rupture when exposed to a pressure differential that is at least equal to the first threshold pressure differential value; and a flow control device configured to allow fluid to enter the inner volume and prevent fluid from exiting the inner volume through the flow control device, thereby allowing the inner volume of the tubular to be pressurized; and a float shoe connected to the second end of the tubular, the float shoe comprising:

a second sealing member configured to prevent fluid flow into and out of the inner volume up to a second pressure differential threshold value, the second sealing member configured to rupture when exposed to a pressure differential that is at least equal to the second threshold pressure differential value; and a float valve arranged to allow fluid to exit the inner volume, the float valve arranged to prevent fluid from entering the inner volume.

2. The apparatus of claim 1, further comprising a float collar between the base and the float shoe.

3. The apparatus of claim 1, wherein the first threshold pressure differential value and the second threshold pressure differential value are equal.

4. The apparatus of claim 1, wherein the base comprises a first seat upon which the first sealing member is seated to prevent movement of the first sealing member relative to the base, and the float shoe comprises a second seat upon which the second sealing member is seated to prevent movement of the second sealing member relative to the float shoe the first seat and the second seat defining a portion of a central flow passage once the first sealing member and the second sealing member have ruptured.

5. The apparatus of claim 4, wherein when the apparatus is positioned within the wellbore, a downhole portion of the first sealing member is seated on the first seat, and a downhole portion of the second sealing member is seated on the second seat.

6. The apparatus of claim 1, wherein the flotation fluid is an inert gas.

7. The apparatus of claim 1, wherein each of the first sealing member and the second sealing member comprises a rubber membrane.

8. A method comprising:

determining a pressure at which collapse of a floated section of an apparatus being run in a wellbore is prevented, wherein determining the pressure comprises calculating a maximum allowable equivalent circulating density and choosing the pressure to be a pressure at which an actual equivalent circulating density at the pressure is less than the maximum allowable equivalent circulating density;

pressurizing the floated section to at least the determined pressure;

running the apparatus in the wellbore, the apparatus comprising:

a tubular defining the floated section;

a base connected to a first, uphole end of the tubular, the base comprising:

a first sealing member configured to prevent fluid flow into and out of the floated section up to a first threshold pressure differential value; and a flow control device configured to allow fluid to enter the floated section and prevent fluid from exiting the floated section through the flow control device, wherein the base defines a pathway connecting the flow control device to the floated section; and a float shoe connected to a second, downhole end of the tubular, the float shoe comprising a second sealing member configured to prevent fluid flow into and out of the floated section up to a second threshold pressure differential value, the float shoe further comprising a float valve arranged to allow fluid to exit an inner volume of the floated section, the float valve arranged to prevent fluid from entering the inner volume;

after running the apparatus, rupturing the first sealing member by exposing the first sealing member to a pressure differential that is at least equal to the first threshold pressure differential value;

after rupturing the first sealing member, rupturing the second sealing member by exposing the second sealing member to a pressure differential that is at least equal to the second threshold pressure differential value; and securing the tubular within the wellbore.

9. The method of claim 8, wherein the first threshold pressure differential value and the second threshold pressure differential value are equal.

10. The method of claim 8, wherein pressurizing the floated section comprises injecting a flotation fluid through the flow control device into the floated section before positioning the apparatus within the wellbore.

11. The method of claim 10, wherein the flotation fluid is an inert gas.

12. The method of claim 10, further comprising determining the amount of flotation fluid to inject into the floated section of the apparatus to pressurize the floated section to at least the determined pressure.

13. The method of claim 10, wherein the wellbore comprises a horizontal section, and running the apparatus in the wellbore comprises positioning the apparatus within the horizontal section.

14. The method of claim 10, further comprising:

displacing the flotation fluid within the floated section with a surrounding fluid within which the apparatus is submerged; and circulating the surrounding fluid through the apparatus until a rheology of the surrounding fluid for cementing is reached.

* * * * *